US006439949B1

(12) United States Patent
Lucas et al.

(10) Patent No.: US 6,439,949 B1
(45) Date of Patent: Aug. 27, 2002

(54) MOVING TOY AND A METHOD OF USING THE SAME

(75) Inventors: Christopher F. Lucas, Buffalo, NY (US); James R. Bauman, Evanston, IL (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/847,994

(22) Filed: May 4, 2001

(51) Int. Cl.[7] ..... A63H 23/00

(52) U.S. Cl. ..... 446/158; 446/156; 446/330; 446/352; 446/353; 273/447; 273/448; 273/140; 273/443; 273/456

(58) Field of Search ..... 446/158, 352, 446/353, 153, 156, 330, 356, 368; 273/447, 448

(56) References Cited

U.S. PATENT DOCUMENTS

| | | | | |
|---|---|---|---|---|
| 726,021 | A | | 4/1903 | Bryan |
| 1,393,617 | A | | 10/1921 | Frame |
| 1,635,770 | A | * | 7/1927 | Starke |
| 1,639,442 | A | * | 8/1927 | Strauss et al. |
| 2,098,166 | A | * | 11/1937 | Rubenstein |
| 2,703,469 | A | | 3/1955 | Raizen |
| 2,724,205 | A | | 11/1955 | Howard |
| 2,752,730 | A | * | 7/1956 | Bellett et al. |
| 2,813,365 | A | | 11/1957 | Cross |
| 2,933,315 | A | | 4/1960 | Carr, Jr. |
| 2,990,645 | A | | 7/1961 | Polzin |
| 3,077,698 | A | | 2/1963 | Glass et al. |
| 3,269,056 | A | * | 8/1966 | Hockman et al. |
| 3,464,154 | A | * | 9/1969 | Di Leva |
| 3,505,753 | A | | 4/1970 | Henderson |
| 3,601,922 | A | * | 8/1971 | Shaffer |
| 3,634,968 | A | | 1/1972 | Muto |
| 3,808,734 | A | * | 5/1974 | Suzuki |
| 4,068,401 | A | | 1/1978 | Saitoh |
| 4,135,326 | A | * | 1/1979 | Tong |
| 4,224,759 | A | * | 9/1980 | Saint-Pierre et al. |
| 4,674,223 | A | | 6/1987 | Pearce |
| 4,687,456 | A | * | 8/1987 | Wang |
| 4,713,037 | A | * | 12/1987 | Tong |
| 4,810,226 | A | * | 3/1989 | Takahashi et al. |
| 5,050,876 | A | | 9/1991 | Chuang |
| 5,197,913 | A | * | 3/1993 | Suzuki |
| 5,931,715 | A | | 8/1999 | Chang |
| 6,022,025 | A | * | 2/2000 | Chuang |
| 6,050,022 | A | | 4/2000 | Brick |

OTHER PUBLICATIONS

Fish 'n Reel, Fisher–Price Toy Fair 2000 catalog, p. 54.

* cited by examiner

*Primary Examiner*—Derris H. Banks
*Assistant Examiner*—Ali Abdelwahed
(74) *Attorney, Agent, or Firm*—Cooley Godward LLP

(57) ABSTRACT

An apparatus including an appendage coupled to a body and a drive. The drive produces a force that causes the appendage to move with respect to the body. When the apparatus is resting on a support surface, the force produced by the drive is insufficient to overcome the force produced by the weight of the apparatus.

10 Claims, 12 Drawing Sheets

MOVING TOY AND A METHOD OF USING THE SAME

TECHNICAL FIELD AND INDUSTRIAL APPLICABILITY OF THE INVENTION

This invention relates generally to toy figures for use by children, and more particularly to toy figures that create life-like motion or other effects, and most particularly to a toy figure that simulates the motion of a hooked fish.

BACKGROUND OF THE INVENTION

Children generally enjoy toys that allow them to simulate the activities of adults. A popular category of these "simulator toys" is fishing toys. A variety of fishing toys is known in the prior art. Some of the toys in the prior art include active fish and others include passive fish.

An example of a fishing toy with an active fish is found in U.S. Pat. No. 6,022,025 issued to Chuang ("Chuang"). Chuang discloses a fishing toy that provides enhanced play value for children by creating life-like effects. The fishing toy in Chuang includes a simulated fish with a two-speed motor that drives the fish's tail and the fish's mouth. When the fish is placed in water, the motor slowly moves the jaw and rotates the tail to simulate a swimming fish. When the fish is "hooked," the motor moves the jaw and rotates the tail more rapidly to simulate the thrashing of a hooked fish. The fishing toy in Chuang requires a complex two-speed motor and must be used in water, which can be inconvenient for the parent and presents the risk of the child spilling the water.

An example of a fishing toy with a passive fish is described in U.S. Pat. No. 2,703,469 issued to Raizen ("Raizen"). Raizen discloses a fish that can be placed on a support surface. The fish can then be lifted from the support surface with a toy fishing hook. The fishing toy in Raizen does not create any type of motion when it is hooked. Thus, the toy does not present a realistic, and therefore interest-holding, experience to the child.

There is therefore, a need for a toy that can simulate the motion of a hooked fish without complex mechanisms or reliance on immersion in water.

SUMMARY OF THE INVENTION

The disadvantages of the prior art are addressed by the disclosed invention. A toy figure includes a body with a movable appendage and a drive that produces relative motion between the body and the appendage. The forces that the drive produces are insufficient to move the appendage relative to the body when the body is resting on a support surface. Thus, when the figure is moved so that one or both of the body and the appendage are moved out of contact with the support surface, the appendage can move with respect to the body.

In one embodiment, the toy figure simulates a fish. Accordingly, the body may be configured to resemble the body of a fish, the appendage may be configured to resemble a fish's tail and to rotate with respect to the fish's body. When the toy fish is resting on a support surface, the weight of the toy resists the relative motion of the tail and the body. When the toy fish is lifted from a supporting surface, the tail can rotate freely with respect to the body, simulating the thrashing of a hooked fish. The toy fish can be combined with a toy fishing pole, reel, and line with which a user can "hook" the fish and lift it from the surface.

In other embodiments, the toy figure can simulate other animals or action figures.

DETAILED DESCRIPTION AND PREFERRED EMBODIMENTS OF THE INVENTION

Figure 1:
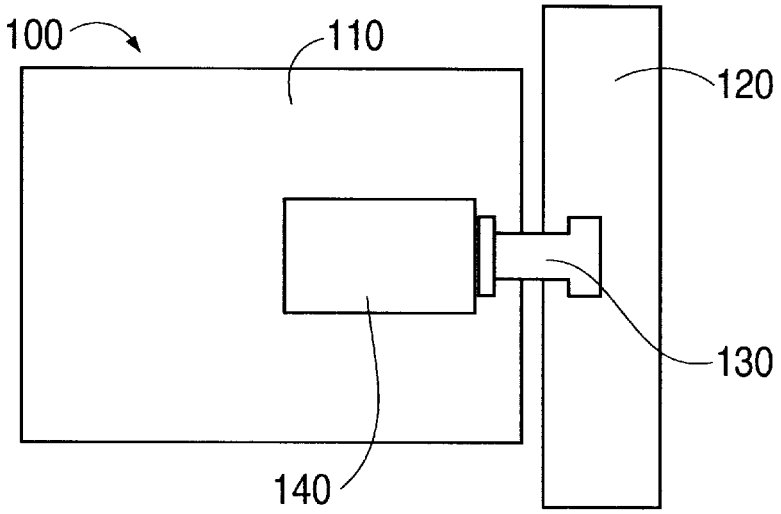
FIG. 1 is a schematic illustration of a toy having a body and a movable appendage embodying the principles of the invention.
Figure 2:
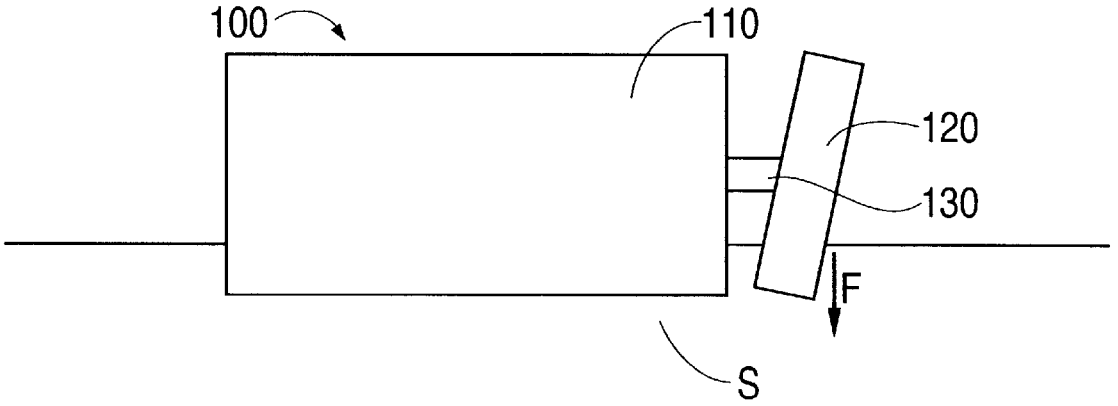
FIG. 2 is a schematic side view of the toy of FIG. 1 disposed on a support surface with the appendage constrained from movement with respect to the body by the support surface.
Figure 3:
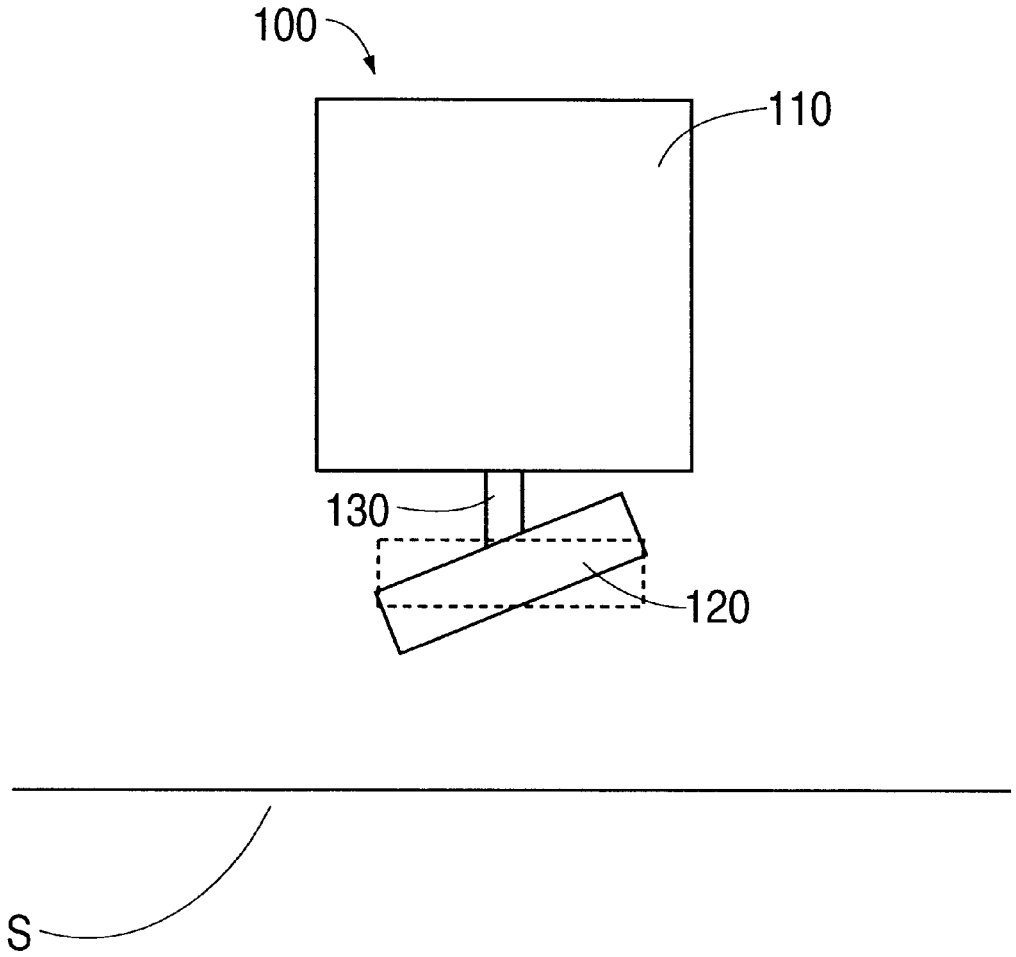
FIG. 3 is a schematic side view of the toy of FIG. 1 removed from the support surface with appendage free to move with respect to the body.

An apparatus and method for creating relative motion between a body and an appendage, simulating the motion of an animal or human, is illustrated schematically in FIGS. 1–3. The disclosed apparatus produces relative cyclical motion between a body and an appendage. The force producing the motion, however, is insufficient to move the appendage relative to the body when the apparatus is resting on a support surface.

As illustrated schematically in FIG. 1, the apparatus 100 includes a body 110, an appendage 120 coupled to body 110, such as by a linkage 130, and a drive 140 that is coupled to body 110 and appendage 120. Drive 140 generates a force that produces cyclical relative motion between appendage 120 and body 110. The cyclical relative motion can be a reciprocating linear motion and/or a continuous or reciprocating rotational motion. Body 110 and appendage 120 are sized so that when body 110 is resting on a support surface, appendage 120 is prevented from completing a cycle of motion by contact with support surface S. This can be achieved by selecting the dimensions and arrangement of appendage 120 with respect to body 110 such that when body 110 is resting on a support surface, appendage 120 contacts the support surface in at least some portion of its range of motion with respect to body 110. The force produced by drive 140 is selected such that the force F produced against support surface S by appendage 120 when it contacts support surface is insufficient to lift body 110 far enough from support surface to allow appendage 120 to complete a cycle of its motion.

Figure 4:
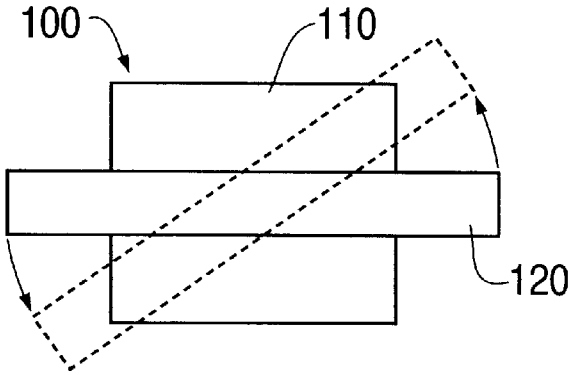
FIG. 4 is schematic rear view of the toy of FIG. 1 with appendage free to move with respect to the body.
Figure 5:
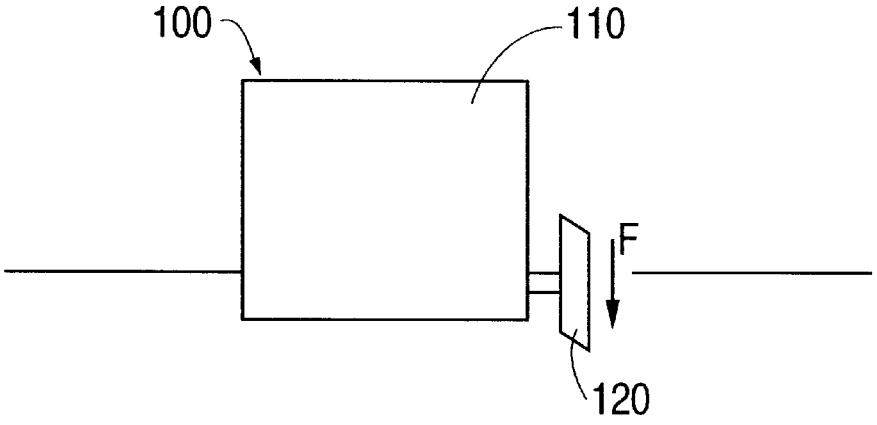
FIG. 5 is a schematic side view of an alternate embodiment of the toy of FIG. 1 disposed on a support surface with the appendage constrained from movement with respect to the body by the support surface.
Figure 6:
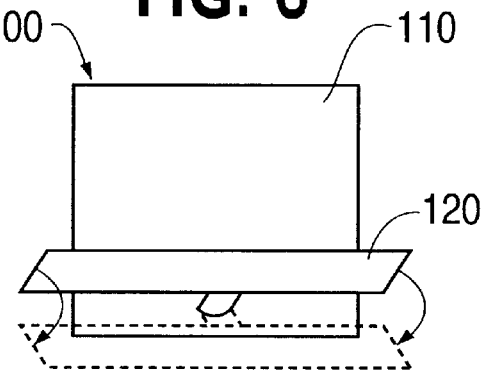
FIG. 6 is a schematic rear view of the alternate embodiment of FIG. 5 with appendage free to move with respect to the body.

As shown in FIGS. 3–4, the cyclical relative motion between the body 110 and the appendage 120 is continual rotational motion. However, as shown in FIGS. 5–6, in an alternative embodiment, the cyclical relative motion is a reciprocating rotational motion. Additionally, in another alternative embodiment the relative motion between body 110 and appendage 120 is reciprocating linear motion.

Figure 7:
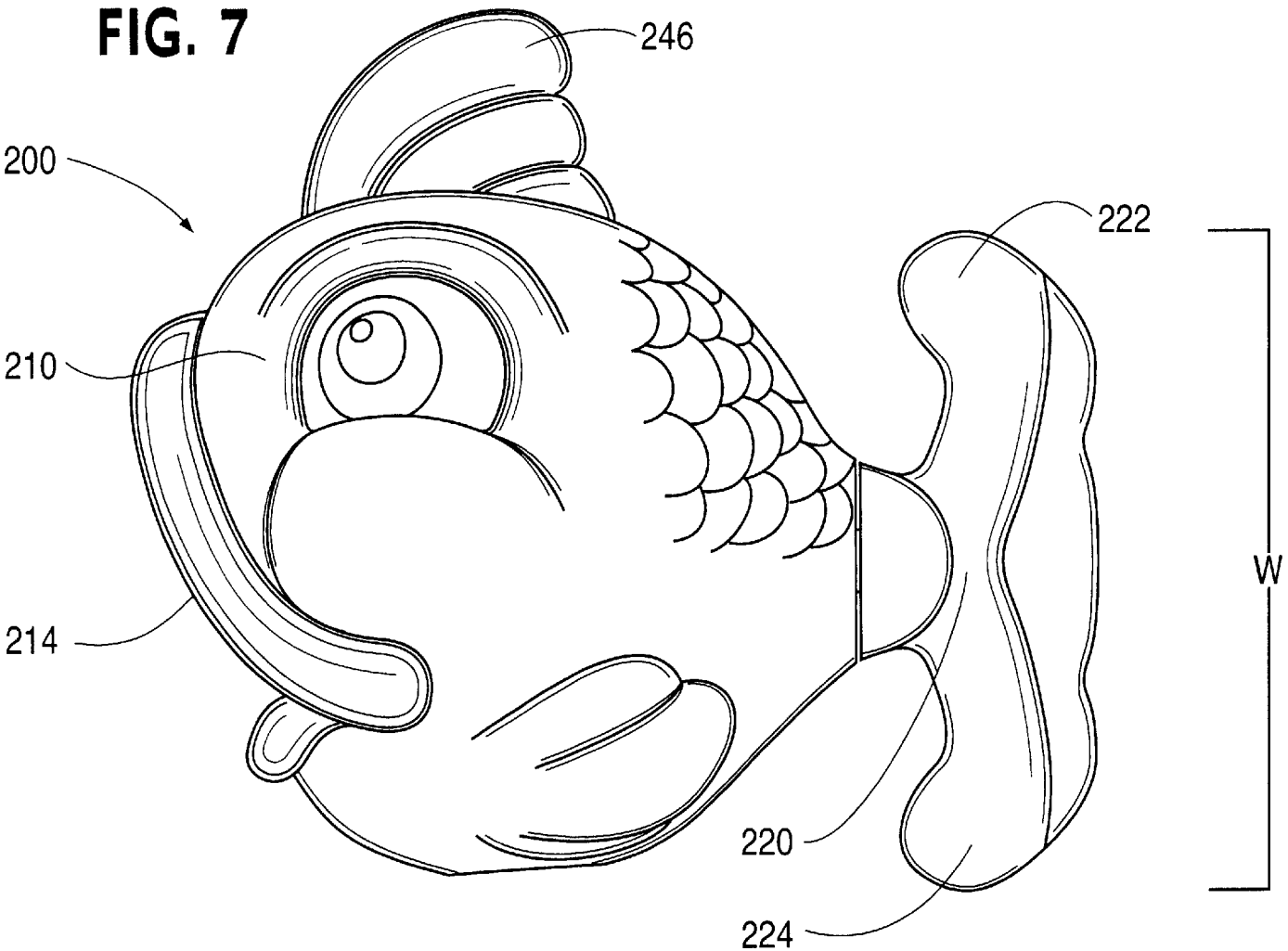
FIGS. 7 and 8 are side and top views of a toy fish embodying the principles of the invention.
Figure 8:
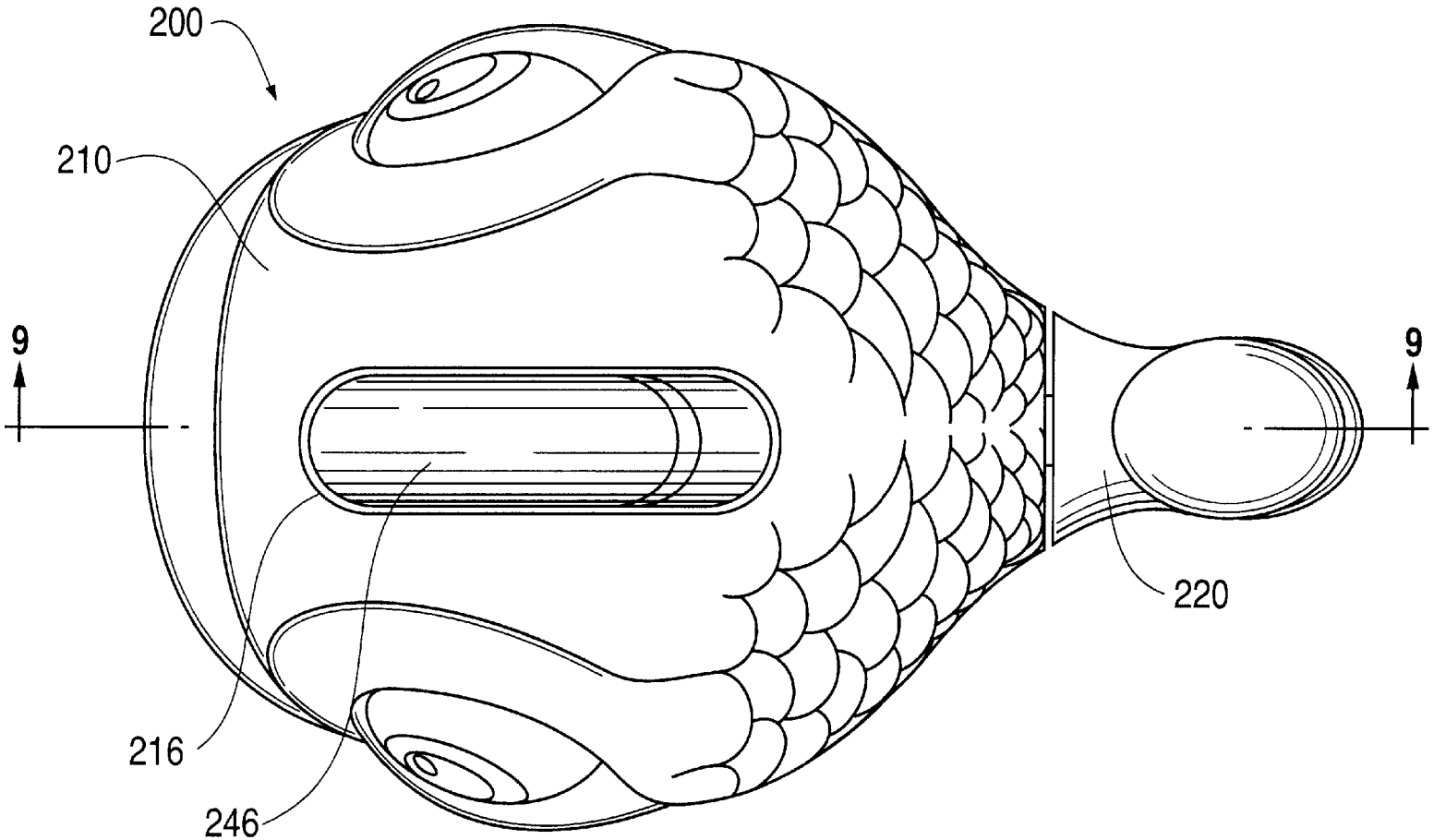
Figure 9:
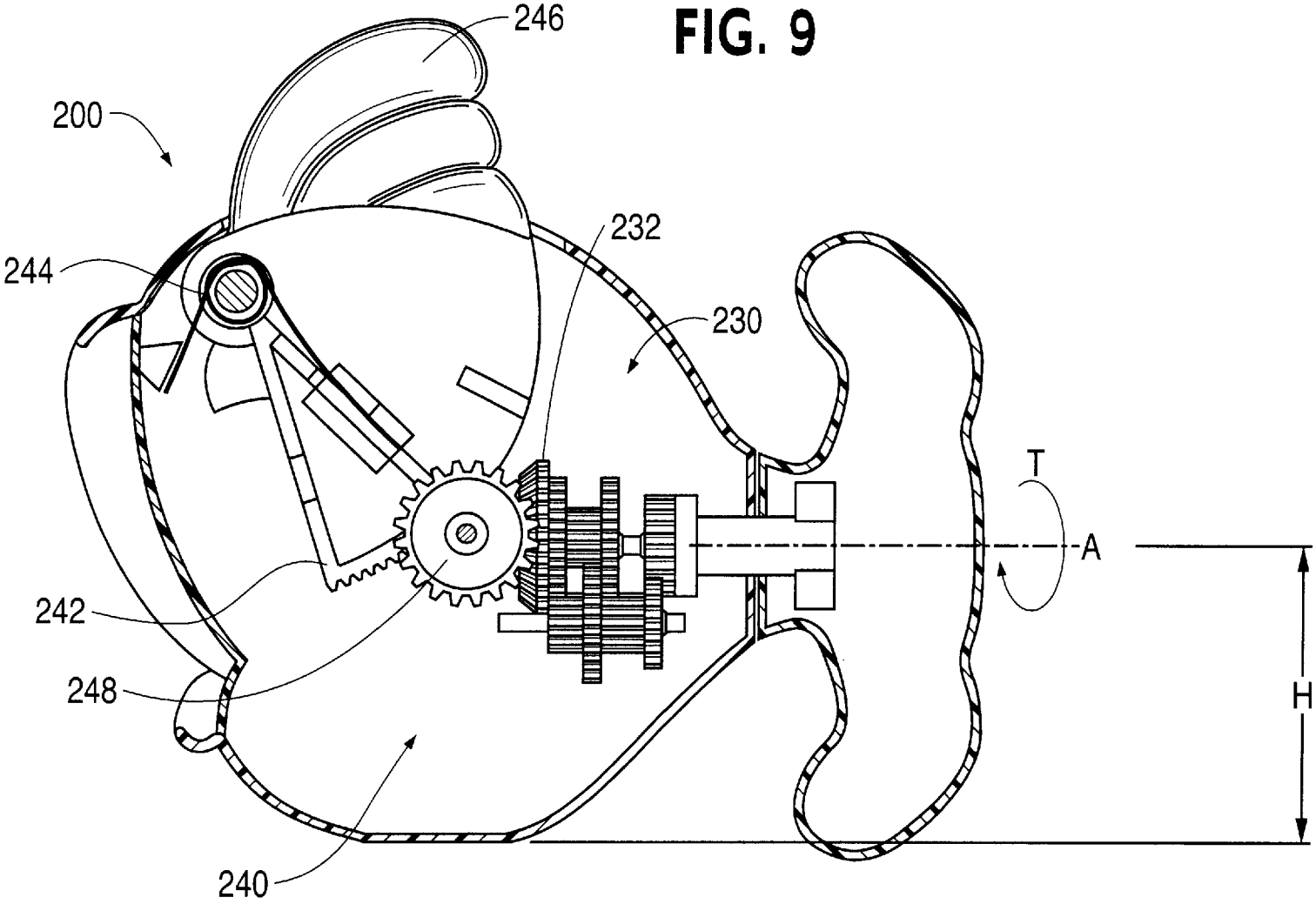
FIG. 9 is a cross-sectional view of the toy fish of FIGS. 7 and 8 taken along line 9—9 of FIG. 8.

An implementation of the invention described and illustrated schematically above is illustrated in FIGS. 7–9. In this embodiment, a toy fish 200 includes a body 210 simulating a fish body and an appendage or tail 220 simulating a fish tail. Tail 220 is coupled to body 210 by drive shaft 230 journaled in body 210, and is disposed for continuous, cyclical rotation about axis A of drive shaft 230. Drive shaft 230 is coupled to, and driven by, drive 240.

Body 210 is configured with a generally flat area 212 on its underside to provide a stable position when fish 200 is placed on a support surface. Body 210 also includes an open mouth 214 by which fish 200 can be engaged by a simulated fishing hook.

The width W of tail 220 is more than twice the height H of the drive shaft axis A above flat area 212. Thus, one of the ends 222, 224 of tail 220 will contact surface S when tail 220 is rotated about axis A, and therefore tail 220 cannot complete a cycle of rotational motion.

Drive 240 (best seen in FIG. 9) includes a rack 242 and a compression spring 244. Rack 242 engages a gear 248 that engages teeth 232 on drive shaft 230 such that linear motion of rack 242 produces rotation of drive shaft 230. An actuator 246 (configured to simulate a dorsal fin) is coupled to one end of rack 242 and projects from opening 216 in body 210 so that it is accessible to a user.

The spring 244 engages rack 242 and is disposed to be compressed when actuator 246 is pressed downwardly and to urge rack upwardly. Gear 248 is slidably mounted within the fish 200. Therefore, when the actuator 246 is being depressed gear 248 slides out of engagement with teeth 232 of drive shaft 230. Thus, when a user pushes actuator 246 downwardly, spring 244 is compressed and rack 242 slides gear out of engagement with teeth 232 until the downward pressure on actuator 246 is released, when gear 248 then engages teeth 232. Spring 244 then urges rack 242 upwardly producing a torque T on drive shaft 230.

Torque T urges tail 220 to rotate in a counterclockwise direction when viewed from the rear of the fish 200. Tail 220 rotates until one of the ends 222, 224 of tail 220 engages support surface S. Torque T produces force F between end 222, 224 against support surface S, which force is insufficient to lift the rear of the fish far enough for tail 220 to rotate further.

Figure 10:
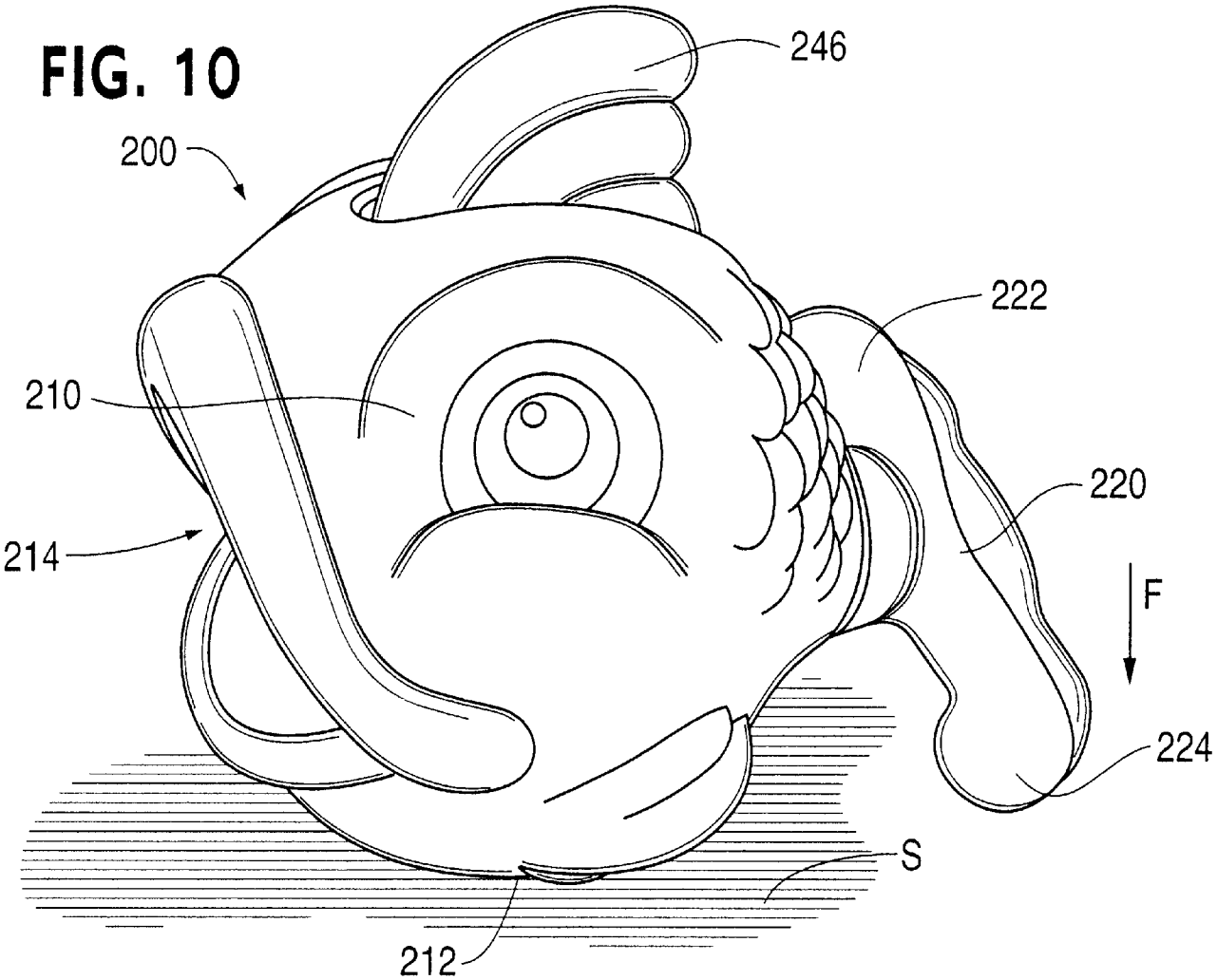
FIG. 10 is a side view of the toy fish of FIGS. 7 and 8 illustrated resting on a support surface.
Figure 11:
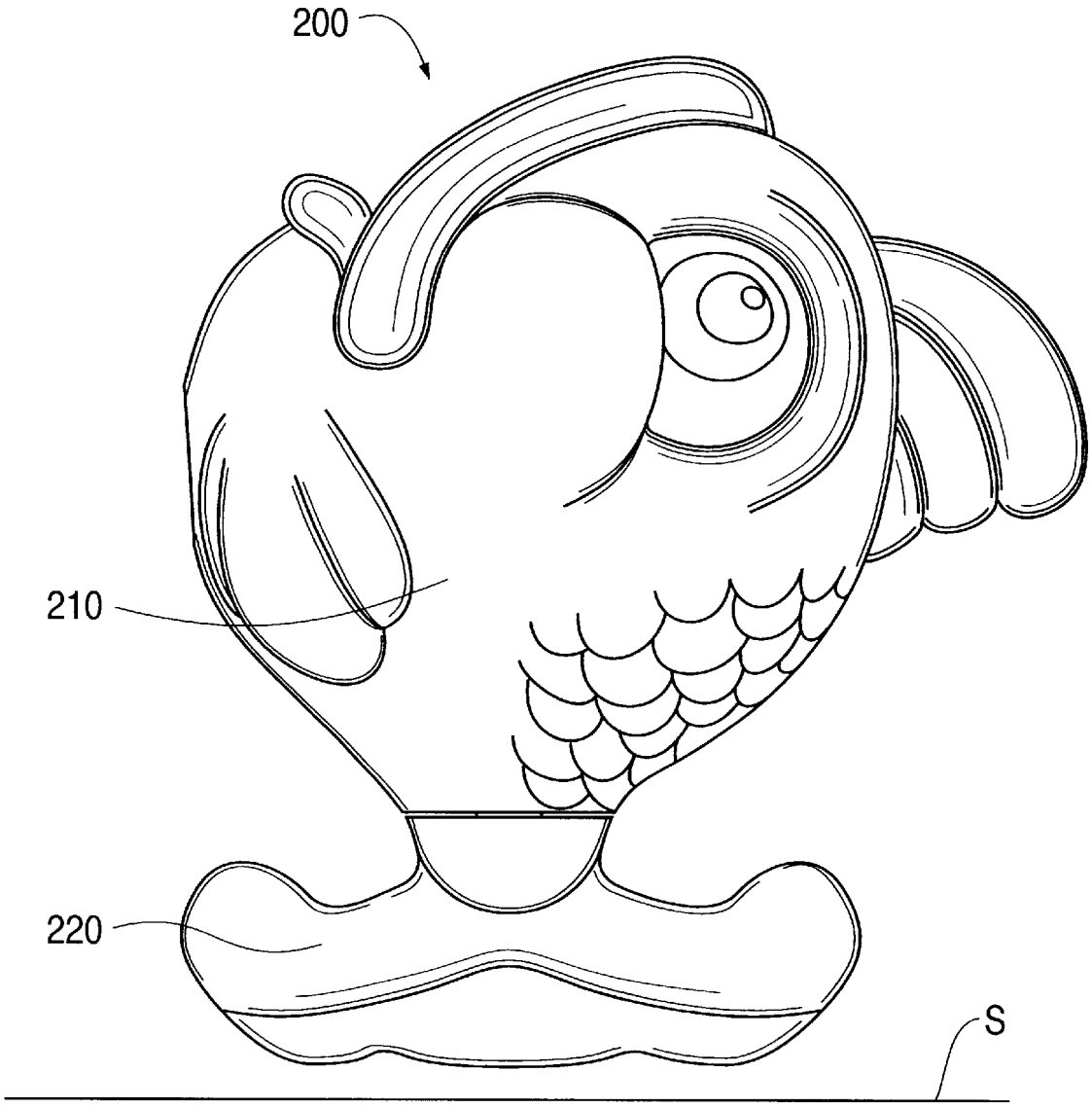
FIG. 11 is a side view of the toy fish of FIGS. 7 and 8 illustrated suspended above a support surface.

FIG. 10 illustrates fish 200 resting on a support surface S. FIG. 11 illustrates fish 200 suspended above support surface with tail 220 free to rotate with respect to body 210.

While the illustrated fish is made of plastic, the fish can be made of any material that can be configured to rest on a support surface. Similarly, the fish can be of any size and shape as long as it is configured to house a drive.

Figure 12:
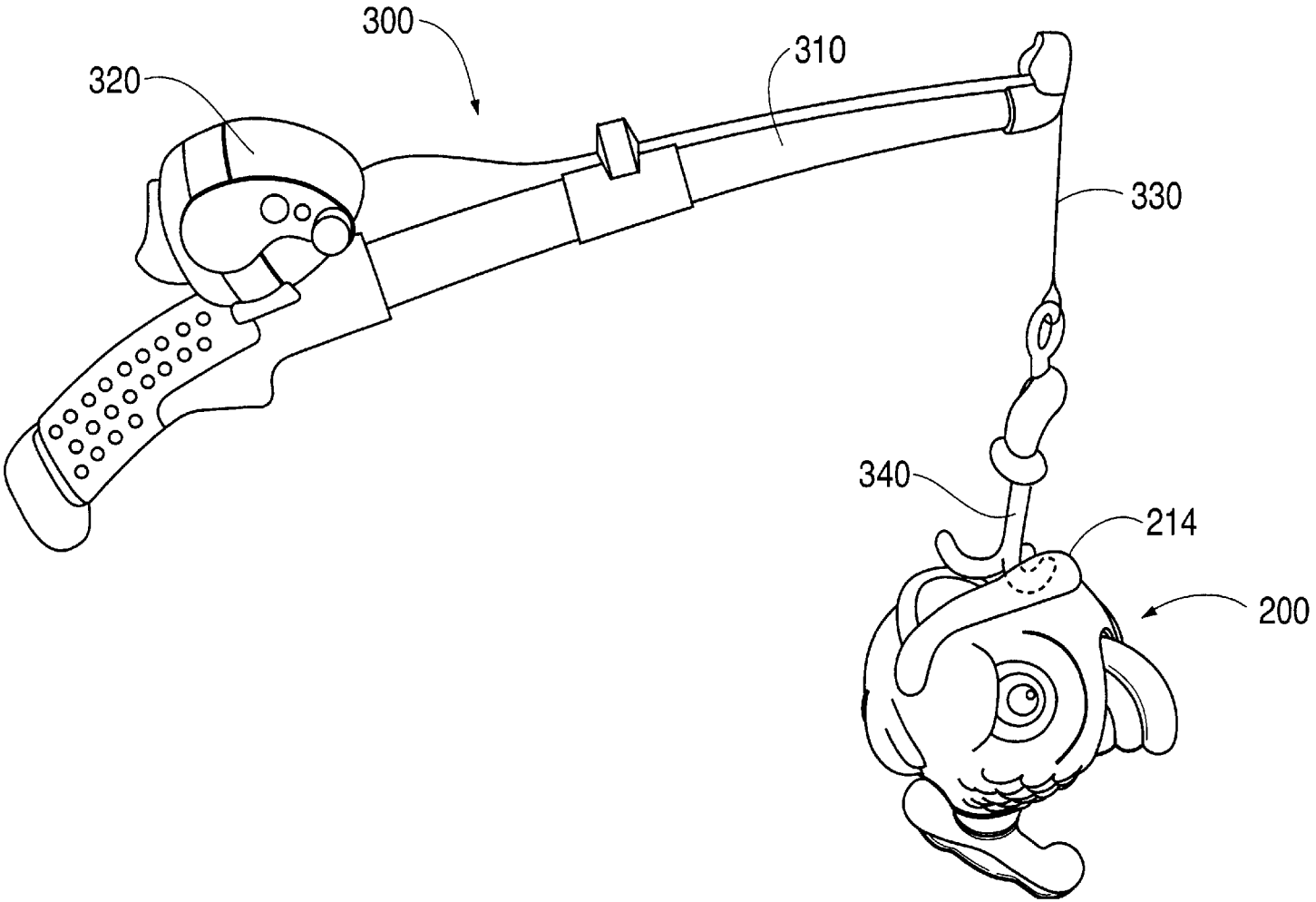
FIG. 12 is a side view of the toy fish of FIGS. 7 and 8 being lifted from a supporting surface by a toy fishing rod.

As illustrated in FIG. 12, the fish embodiment that is illustrated in FIGS. 7 and 8 can be used with a toy fishing pole 300. Fishing pole 300 includes a rod 310, a reel 320, a line 330, and a hook 340. Hook 340 is shaped for engagement with the upper portion of the mouth 214 of the fish. Hook 340 can be raised or lowered with respect to rod 310 by gathering line 330 onto, or releasing line 330 from, reel 320.

To use the fish 200 and pole 300 to simulate fishing, the user activates drive 240 by fully depressing actuator 246, then places fish 200 on a support surface. The user then releases a desired amount of line 330 from reel 320 and manipulates hook 340 into engagement with mouth 214. The user can then lift fish 200 from the support surface. Once the user lifts fish 200 from the support surface, drive 240 will cause tail 220 to rotate cyclically with respect to body 210, simulating the thrashing motion of a hooked fish.

FIGS. 13–16 illustrate second and third embodiments of the invention. Each of the illustrated embodiments includes a body 410 and an appendage 440. The body 410 has a flat area 416 configured to rest on a support surface S. The appendage 440 is rotatably coupled to body 410 by a drive shaft (not shown) that is located within body 410. The drive shaft is coupled to, and driven by, a drive (also not shown but can be similar to the drive discussed in the preceding embodiment or any other drive that an artisan would select).

Drive 460 may be similar to the drive illustrated in FIG. 9 and described in detail above. Drive 460, however, can be any other type of mechanism that will produce a torque T on drive shaft 450 and thus, relative motion between body 410 and appendage 440.

Similar to the fish embodiment, the width W of appendage 440 is more than twice the height H of the drive shaft axis A above the flat area 416. Thus, when body 410 is resting on support surface S, at least part of appendage 440 will contact support surface before the appendage can complete a cycle of rotational motion.

Similar to the above-described fish embodiment, a torque T supplied by the drive to the drive shaft urges appendage 440 to rotate. Appendage 440 rotates until part of the appendage contacts support surface S. The force F that the torque T produces between appendage 440 and support surface S is insufficient to lift the body far enough off of the support surface for the appendage to rotate further.

Figure 13:
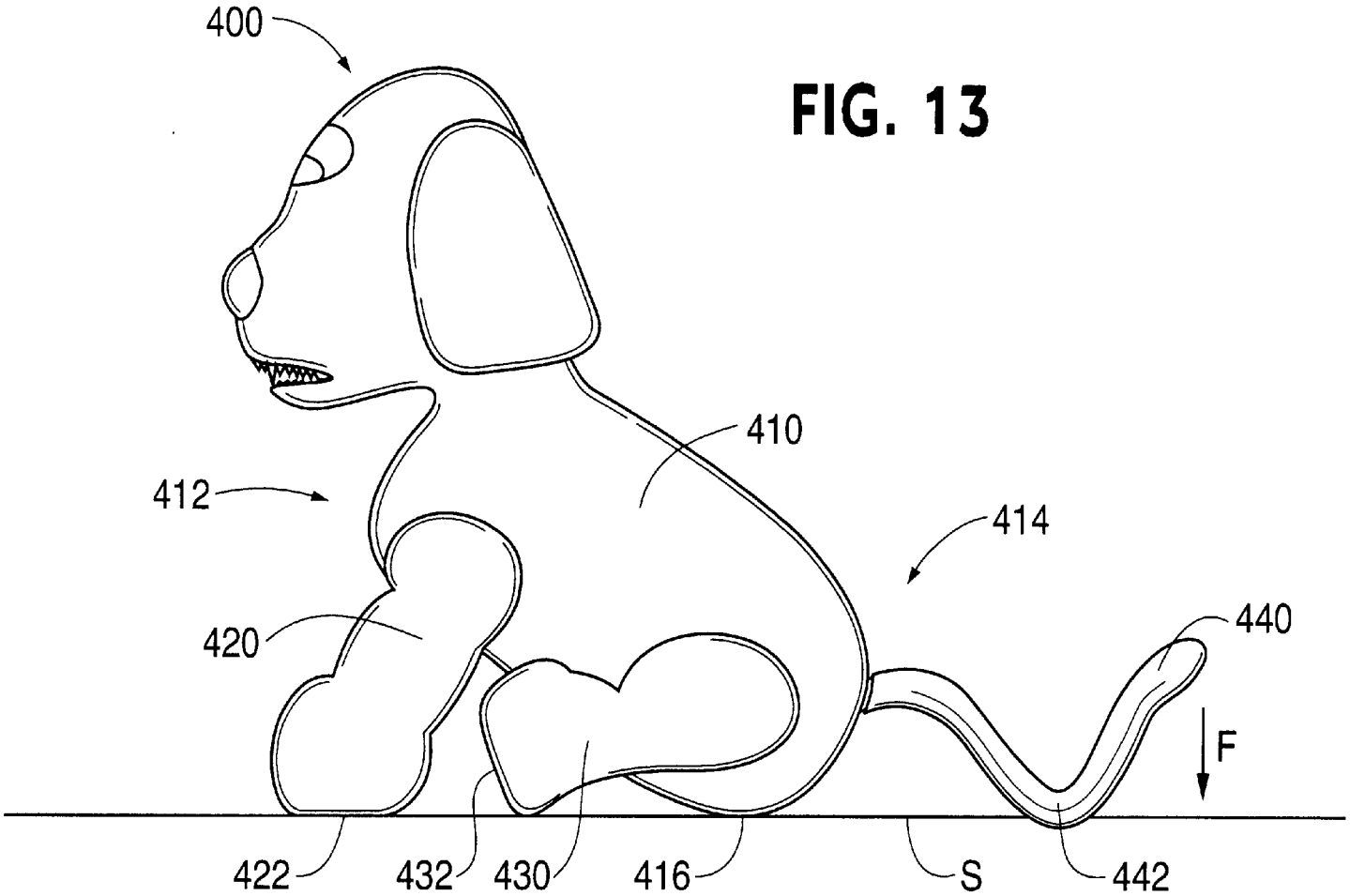
FIG. 13 is a schematic illustration of a second embodiment of a toy embodying the principles of the invention, configured to simulate a dog, in a seated position.
Figure 14:
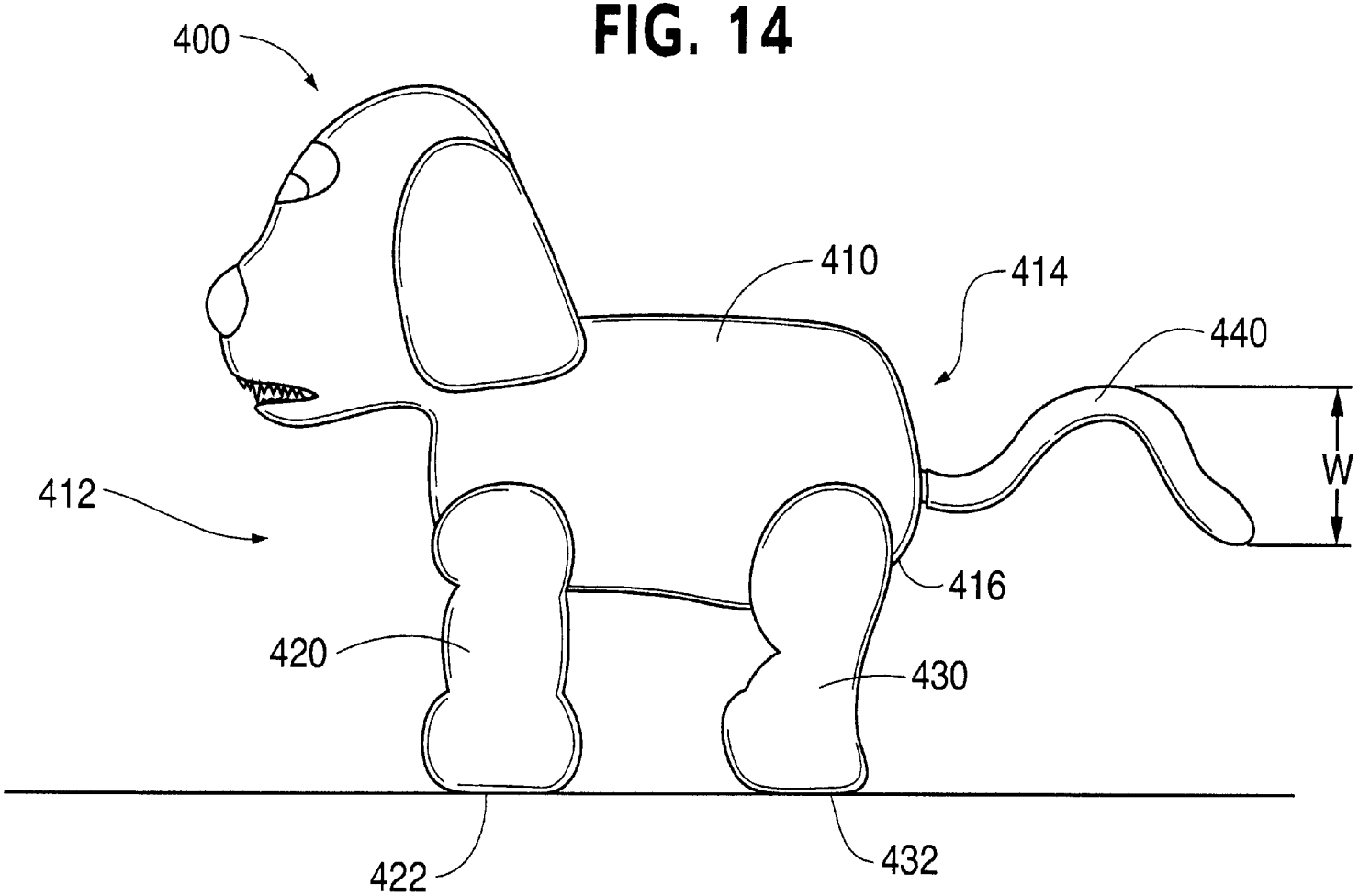
FIG. 14 is a schematic illustration of the toy of FIG. 13 in a standing position with tail free to move with respect to body.

FIGS. 13 and 14 illustrate the second embodiment of the invention. In this embodiment, a toy dog 400 includes a body 410 simulating a dog's body and an appendage 440 simulating a dog's tail. Body 410 includes front and rear legs 420, 430 with bottom surfaces 422, 432 that are adapted to rest on a support surface. Body 410 also includes a front end 412 and a rear end 414. The flat area 416 is located on the rear end 414 of dog 400.

Dog 400 may be placed in a seated configuration or in an upright configuration. Rear legs 430 are rotatably coupled to body 410, and are disposable in two positions. In a first position, rear legs 430 are substantially parallel to the body 410. In this position, with flat area 416 placed on a support surface dog 400 may assume a seated configuration. In a second position, rear legs 430 are substantially perpendicular to body 410. With rear legs 430 in their second position and with bottom surfaces 432 of the rear legs 430 resting on a support surface, dog 400 may assume an upright configuration.

To use the dog 400, the user activates the drive, pivots the rear legs 430 into their first position, and places the dog 400 on a support surface in its seated configuration. The user can then lift the dog 400 from its seated configuration, pivot the rear legs 430 into their second position, and place the dog 400 on a support surface in its upright configuration. Once the dog 400 is lifted from the support surface, the drive will cause the tail 440 to rotate cyclically with respect to the body 410.

Figure 15:
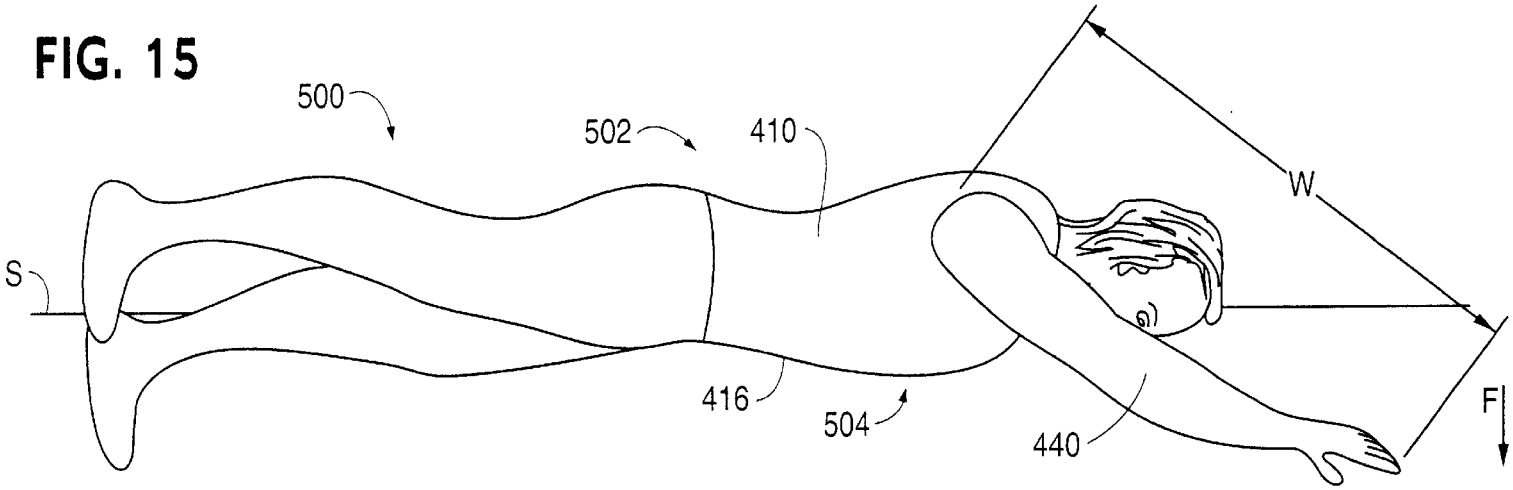
FIG. 15 is a schematic illustration of a third embodiment of a toy embodying the principles of the invention, configured to simulate a human swimming figure, resting on a support surface.
Figure 16:
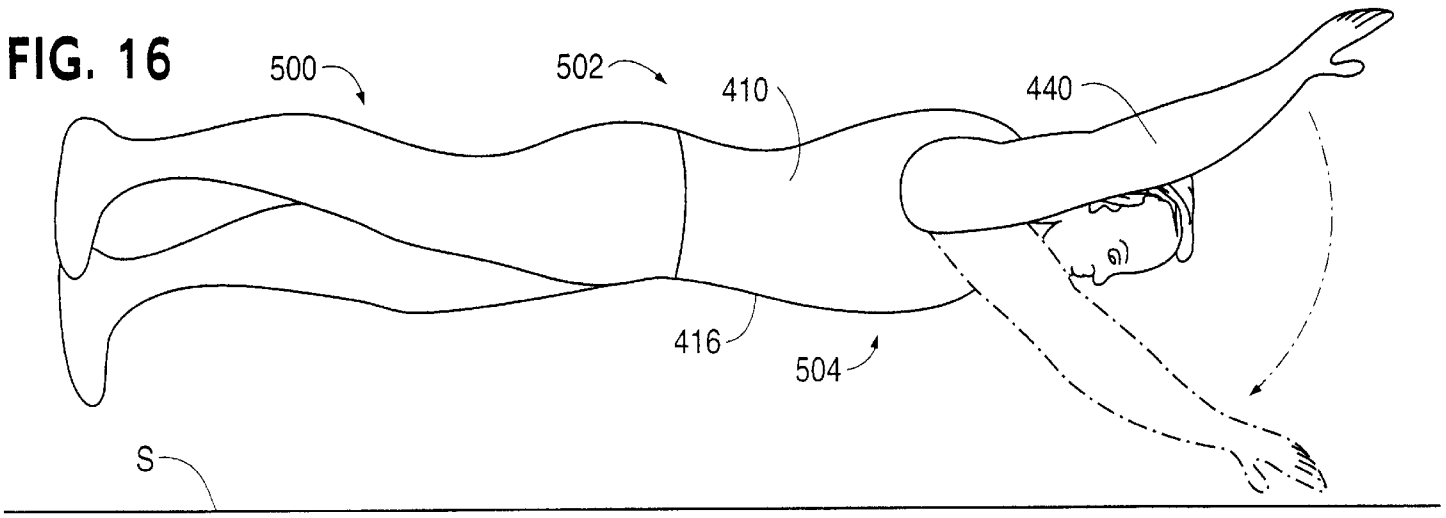
FIG. 16 is a schematic illustration of the toy of FIG. 15 in a lifted position with arm free to move with respect to the body.

FIGS. 15 and 16 illustrate a third embodiment of the invention. In this embodiment, a toy swimmer 500 includes a body 410 simulating a human's body and an appendage 440 simulating a human's arm. The body 410 includes a back side 502 and a front side 504. The flat area 416 is located on the front side 504 of body 410.

To use the swimmer 500, the user activates the drive and places the swimmer 500 on a support surface. The user can then lift the swimmer 500 from the support surface S. Once the swimmer 500 is lifted from the support surface, the drive will cause the arm 440 to rotate cyclically with respect to the body 410.

Other embodiments of the invention are contemplated. The toy can simulate virtually any animal, human, or action figure. More than one appendage could be coupled to the body. The appendage could any appendage appropriate to the selected body, including a leg, a tail, an arm, a head, or another body segment.

We claim:

1. A toy figure comprising:

a body including a longitudinal axis;

an appendage coupled to said body for cyclical relative rotational motion about said longitudinal axis with respect to said body;

a drive coupled to said body and said appendage to produce said relative rotational motion;

said toy figure including a generally planar supporting portion whereby said toy figure is adapted to be supported on a generally planar support surface with said body and said appendage in engagement with said support surface; and wherein said drive produces forces on said body and said appendage that are less than the forces produced by the weight of said toy figure so that said drive cannot produce a full cycle of said relative rotational motion when said toy figure is supported on said support surface but can produce said full cycle of relative motion when at least one of said body and said appendage is not engaged with said support surface.

2. The toy figure of claim 1 wherein said appendage is coupled to said body for continuous rotational motion with respect to said body about said longitudinal axis.

3. The toy figure of claim 1 wherein said appendage is coupled to said body for reciprocal rotational motion with respect to said body about said longitudinal axis.

4. The toy figure of claim 1 wherein said toy figure is configured to resemble a fish and said appendage is a tail.

5. The toy figure of claim 4 wherein said tail is mounted to said body for continuous rotational motion relative to said body about said longitudinal axis.

6. The toy figure of claim 4 wherein said body includes a mouth and further including a toy fishing pole having a hook engagable with said mouth whereby said fish can be lifted from said support surface by engaging said hook with said mouth.

7. The toy figure of claim 1 wherein said toy figure is a quadruped animal and said appendage is a tail coupled to said body for cyclical relative rotational motion about said longitudinal axis.

8. A method of simulating the movement of an appendage on a toy configured to resemble a creature with a movable appendage comprising:

disposing on a support surface a simulated creature having a body and an appendage coupled to said body for cyclical relative motion;

producing a force between said body and said appendage to urge said appendage into said relative motion, said force being insufficient to overcome the force produced by the weight of said creature on the support surface;

lifting said creature from the support surface; and allowing said appendage to move through at least one cycle of said cyclical relative motion.

9. A method of simulating the catching of a fish comprising:

disposing on a support surface a simulated fish having a body and a tail coupled to said body for cyclical relative motion;

producing a force between said body and said tail to urge said tail into said relative motion, said force being insufficient to overcome the force produced by the weight of said fish on the support surface;

lifting said fish from the support surface; and allowing said tail to move through at least one cycle of said cyclical relative motion.

10. The method of claim 9 wherein said fish includes a mouth and the lifting of said fish from the support surface includes engaging a hook with said mouth.

* * * * *